US005821954A

United States Patent [19]

Imai et al.

[11] Patent Number: 5,821,954

[45] Date of Patent: Oct. 13, 1998

[54] INK JET RECORDING DEVICE WITH DUAL EJECTION SIGNAL GENERATORS FOR AUXILIARY EJECTION MODE AND PRINTING MODE

[75] Inventors: Koji Imai, Nagoya; Shuhei Hiwada, Toyoake, both of Japan

[73] Assignee: Brother Kogyo Kabushiki Kaisha, Nagoya, Japan

[21] Appl. No.: 650,448

[22] Filed: May 20, 1996

[30] Foreign Application Priority Data

May 19, 1995 [JP] Japan ..... 7-121170

[51] Int. Cl.[6] ..... B41J 29/38; B41J 2/165

[52] U.S. Cl. ..... 347/35; 347/5; 347/14

[58] Field of Search ..... 347/5, 14, 23, 347/31, 35

[56] References Cited

U.S. PATENT DOCUMENTS

| | | | |
|---|---|---|---|
| 3,946,398 | 3/1976 | Kyser et al. . | |
| 4,716,418 | 12/1987 | Heinzl et al. | 347/68 |
| 4,723,129 | 2/1988 | Endo et al. . | |
| 4,791,435 | 12/1988 | Smith et al. | 347/17 |
| 4,879,568 | 11/1989 | Bartky et al. . | |
| 5,339,098 | 8/1994 | Nagatomo et al. . | |
| 5,625,395 | 4/1997 | Imai | 347/71 |

FOREIGN PATENT DOCUMENTS

| | | | |
|---|---|---|---|
| B2-61-59914 | 12/1986 | Japan . | |
| A-63-247051 | 10/1988 | Japan . | |
| B2-4-64312 | 10/1992 | Japan . | |
| 000576285 | 12/1993 | Japan | B41J 2/205 |

*Primary Examiner*—Benjamin R. Fuller
*Assistant Examiner*—Thien Tran
*Attorney, Agent, or Firm*—Oliff & Berridge, PLC

[57] ABSTRACT

In an ink jet recording device selectively operable in an auxiliary ejection mode and a printing mode, dual ejection signal generators are provided. In the auxiliary ejection mode, a carriage is moved to face a flush station and ink droplets are auxiliary ejected from the nozzles in accordance with ejection signals produced by a CPU. Ejection signals for use in the printing mode are produced from an encoder signal which is the output from a photo-interrupter provided in the carriage.

16 Claims, 7 Drawing Sheets

INK JET RECORDING DEVICE WITH DUAL EJECTION SIGNAL GENERATORS FOR AUXILIARY EJECTION MODE AND PRINTING MODE

BACKGROUND OF THE INVENTION

1. Field of the Invention

The present invention relates to an ink jet recording device selectively operable in an auxiliary ejection mode and a printing mode wherein in the auxiliary ejection mode, ink ejection is performed before start of printing and after completion of one page printing, and in the printing mode, ink droplets are ejected toward a recording medium for recording.

2. Description of the Related Art

Recently, ink jet printers are drawing customers' attention in the market because, among other reasons, they are simple in operational principle and can easily accomplish multi-gradation and color printing. Particularly, because of good ink ejection efficiency and inexpensive running cost, the number of drop-on-demand ink jet printers sold in the market is increasing. Unlike printers which continuously eject ink droplets regardless of whether or not they are used for printing, drop-on-demand printers eject only ink droplets that are required for printing.

Generally, drop-on-demand ink jet printers are classified as Kyser types as disclosed in Japanese Patent Publication (B2) No. Sho-53-12138 and as thermal jet type as disclosed in Japanese Patent Publication (B2) No. Sho-61-59914. Both types have problems. For example, Kyser types cannot be made in compact size and thermal jet types require thermally resistive ink because the ink is heated up to a high temperature. In order to solve such problems, a new type of ink jet printer has been proposed, as disclosed in Japanese Laid-Open Patent Publication (A1) No. Sho-63-247051, which uses a share mode print head.

In the ink jet printer head, the tip end of the nozzle from which ink droplets are ejected is exposed to atmosphere when printing is not performed. Depending on print data, there may be some nozzles which do not eject ink droplets even during printing. If the ink jet print head remains unused for a long period of time, clogging of the nozzle is liable to occur resulting from evaporation of water or solvent components contained in ink. To prevent the clogging of the nozzle, an auxiliary ejection of ink is performed precedent to printing.

A driver IC supplies electrical energy to a print head at a timing determined by an ejection signal. The ejection signal to be applied to the driver IC is either generated by a central processing unit (CPU) for controlling the overall operations of the ink jet recording device or generated by another hardware arrangement. In the latter case, the ejection signal is generated based on the output of an encoder. The encoder outputs timing pulses in accordance with a scan of the print head.

However, in the former case, if generally used CPUs are burdened with generation of the ejection signals in synchronism with the scan speed of the print head other than processing print data received from an external device and scanning the print head over a recording medium, a high speed printing cannot be achieved. To perform high speed printing, a high quality, expensive CPU must be used. The use of a hardware arrangement to generate the ejection signals relieves the load imposed on the CPU, so that a high quality output is achieved, but there is no need to use the high quality, expensive CPUs. However, because the print head is fixedly placed in a predetermined position when performing the auxiliary ejection, timing pulses are not available from the encoder. Therefore, a special circuit is required which generates timing pulses when the auxiliary ejection is performed.

SUMMARY OF THE INVENTION

The present invention has been made to solve the aforementioned problems, and accordingly it is an object of the present invention to provide an ink jet recording device including a recording head, head information generating means, ejection signal generating means, a driver, control means, and selection means. The recording head is movable with respect to a recording medium and ejecting an ink droplets to record data when electrical energy is supplied. The head information generating means generates information regarding a moving amount of the recording head. The ejection signal generating means generates a first ejection signal based on the information generated by the head information generating means. The driver drives the recording head. The control means receives print data from an external device and produces a dot print signal based on the print data. Also, the control means sets the driver to either one of a print mode and an auxiliary ejection mode. Further, the control means generates a second ejection signal. In the print mode, the dot print signal is applied to the driver, and in the auxiliary ejection mode, a predetermined dot print signal is applied to the driver. The selection means selects one of the first ejection signal and the second ejection signal and applies selected ejection signal to the driver. The first ejection signal is selected when the print mode is set and the second ejection signal is selected when the auxiliary ejection mode is set. In the printing mode, the driver drives the recording head to supply electrical energy in accordance with the first ejection signal and the dot print signal. In the printing mode, the driver drives the recording head to supply electrical energy in accordance with the second ejection signal and the predetermined dot print signal.

The ejection signal generating means and the selection means are formed with an application specific integrated circuit, and the control means includes a central processing unit. In the preferred embodiment, the head information generating means includes an optical encoder for generating pulses in accordance with movement of the head. The number of pulses generated from the encoder is in proportion to the moving amount of the recording head.

The control means sets the recording device to the auxiliary ejection mode when the ink jet recording device is powered. The control means also sets the driver to the auxiliary election mode when an amount of data recorded by the recording head exceeds a predetermined value in the printing mode.

In accordance with another aspect of the invention, there is provided an ink jet recording device including a power switch, a recording head, a flushing member, mode setting means, head information generating means, a central processing unit, first ejection signal generating means, second ejection signal generating means, and selection means. The recording device is powered when the power switch is operated. The recording head ejects an ink droplet when electrical energy is supplied. The flushing member is disposed in a predetermined position. The driver drives the recording head in selective one of a print mode and an auxiliary ejection mode. When the driver is set to the print mode, the ink droplet is elected to record data on a recording medium and when the driver is set to the auxiliary ejection mode, the ink droplet is ejected toward the flushing member. The mode setting means sets the driver to operate in selective one of the auxiliary ejection mode and the print mode. The moving means moves the recording head. The head information generating means generates information regarding a moving amount of the recording head. The central processing unit generates a clock signal. The first ejection signal generating means generates a first ejection signal based on the information generated by the head information generating means. The second ejection signal generating means generates a second ejection signal based on the clock signal generated by the central processing unit. The selection means selects one of the first ejection signal and the second ejection signal and applies a selected election signal to the driver. The first ejection signal is selected when the print mode is set and the second ejection signal is selected when the auxiliary ejection mode is set. In the print mode, the driver drives the recording head to supply electrical energy at a timing determined by the first ejection signal, and in the print mode, at a timing determined by the second ejection signal.

The central processing unit instructs the moving means to move the recording head to face the flushing member when the mode setting means sets the auxiliary election mode. Also, the central processing unit instructs the mode setting means to set to the auxiliary ejection mode when the power switch is operated. Further, the central processing unit instructs the mode setting means to change the print mode to the auxiliary ejection mode when an amount of data recorded by the recording head exceeds a predetermined amount in the printing mode.

The first ejection signal further determines a duration of time at which the electrical energy is supplied to the recording head.

In the type wherein the recording head has partition walls defining an ink channel, the duration of time determined by the first ejection signal is determined by the length of the ink channel and sound speed propagating in ink filled with the ink channel.

BRIEF DESCRIPTION OF THE DRAWINGS

The particular features and advantages of the invention as well as other objects will become more apparent from the following description taken in connection with the accompanying drawings, in which.

DETAILED DESCRIPTION OF PREFERRED EMBODIMENTS

A preferred embodiment of the present invention will be described while referring to the accompanying drawings. In the following description, the expression "left", "right", "front" and "rear" are used to define the various parts when the ink jet recording device is disposed in an orientation in which it is intended to be used.

Figure 1:
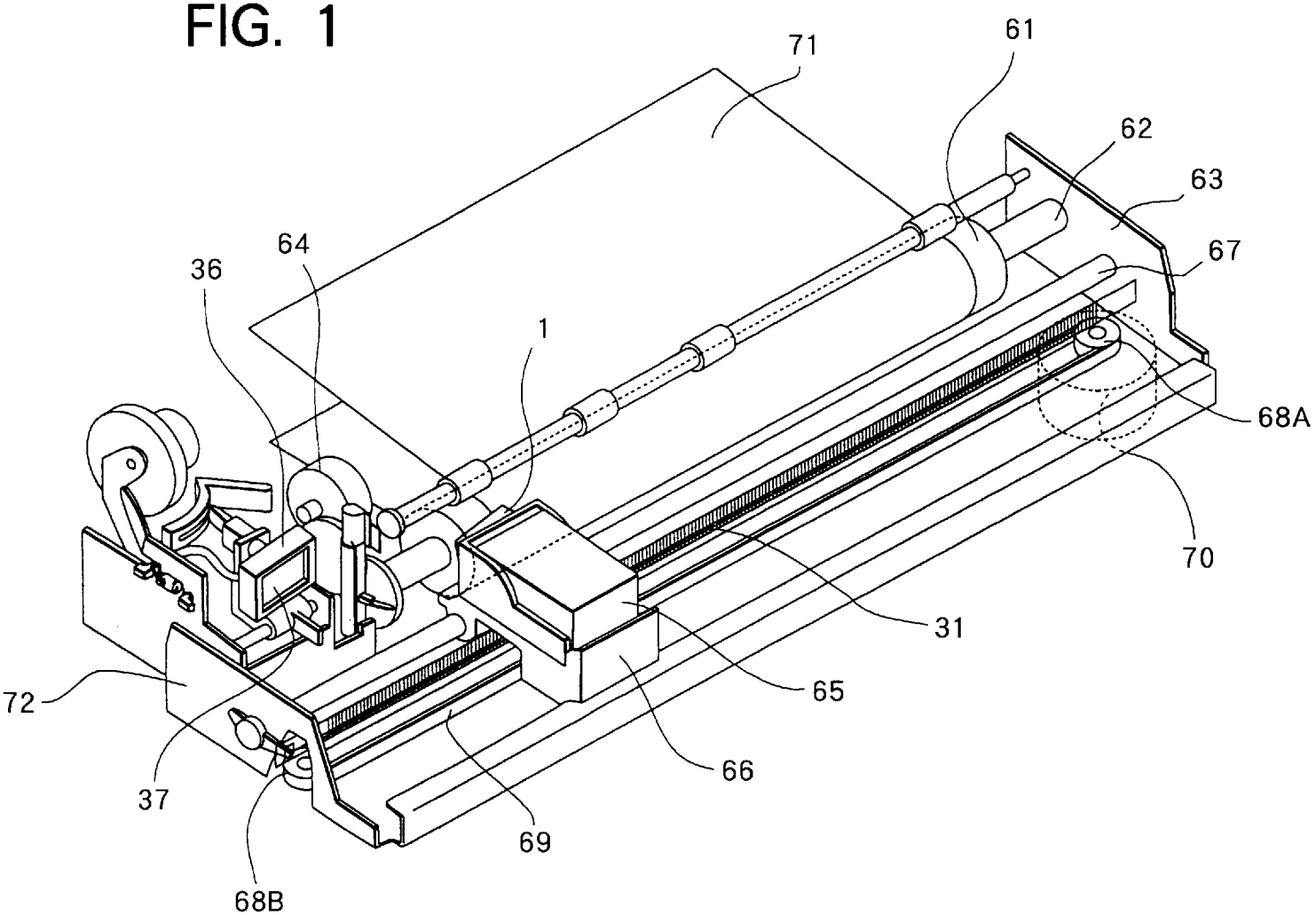
FIG. 1 is a perspective view showing a part of an ink jet recording device according to an embodiment of the present invention.

FIG. 1 shows a structure of an ink jet recording device according to the preferred embodiment of the present invention. The printer includes a platen 61 with a shaft 62 which is rotatably supported on a frame 63. The platen 61 is rotated by a motor 64. A piezoelectric ink jet head 1 is disposed in confrontation with the platen 61 on which a recording medium 71 is supported. The ink jet head 1 is mounted on a carriage 66 together with an ink cartridge 66. The carriage 66 is slidably movably supported on a guide rod 67 extending in parallel with the longitudinal direction of the platen 61. The carriage 66 is fixedly connected to a timing belt 69 stretched between a pair of spaced apart pulleys 68A and 68B. A counterpart pulley 68A is rotated by a reversible carriage motor 70, thereby moving the timing belt 69 back and forth. The carriage 66 is thus transported back and forth along the platen 61 to can the widthwise direction of the recording medium 71.

Figure 2:
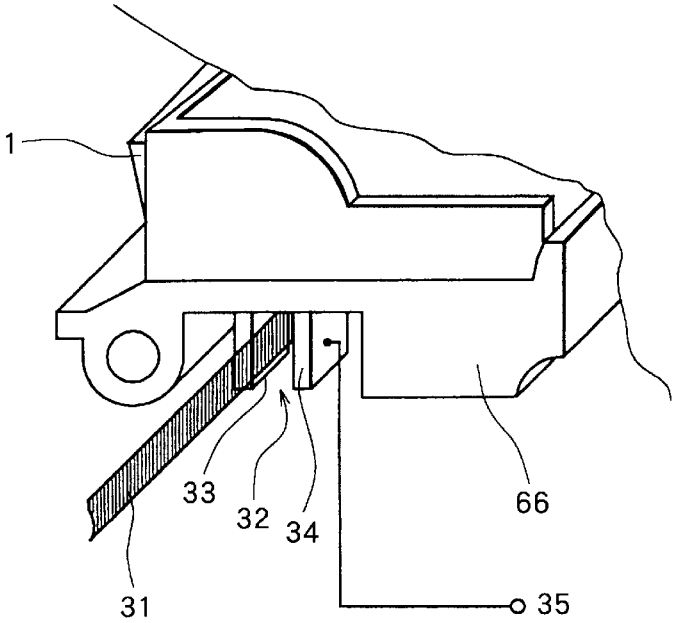
FIG. 2 is a perspective view showing a part of a photo-interrupter used in the embodiment of the present invention.

A slit-formed plate 31 is attached to the frame 63 in an orientation in parallel with the guide rod 67. The plate 31 is formed with a plurality of vertically extending slits. The slits are arranged at equidistant pitch of 169 $\mu$m in the axial direction of the guide rod 67. As shown in FIG. 2, a photo-interrupter 32 is fixedly attached to the lower surface of the carriage 66. The photo-interrupter 32 includes a light emitting element 33 and a light receiving element 34, between which the slit-formed plate 31 is intervened. In accordance with the movement of the carriage 66, the photo-interrupter 32 outputs pulses. When the light emitted from the light emitting element 33 is interrupted by the slit-formed plate 31, a photo-transistor used as the light receiving element 34 outputs 5 volts, and when the light emitted from the light emitting element 33 passes through the slit and received at the photo-transistor, the latter outputs 0 (zero) volt. More specifically, a single pulse is generated each time when the carriage 66 moves 169 $\mu$m along the platen 61. The pulses generated from the photo-interrupter 32 will be referred to as an encoder signal 35.

A flush station 36 is provided in a space between the left side frame 72 and the left end of the platen 61. The flush station 36 is formed with a pad 37 made of water absorbable porous material such as urethane foam. The ejection face of the ink jet head 1 is brought into contact with the pad 37 when the carriage 66 is moved to the leftmost position.

Figure 3:
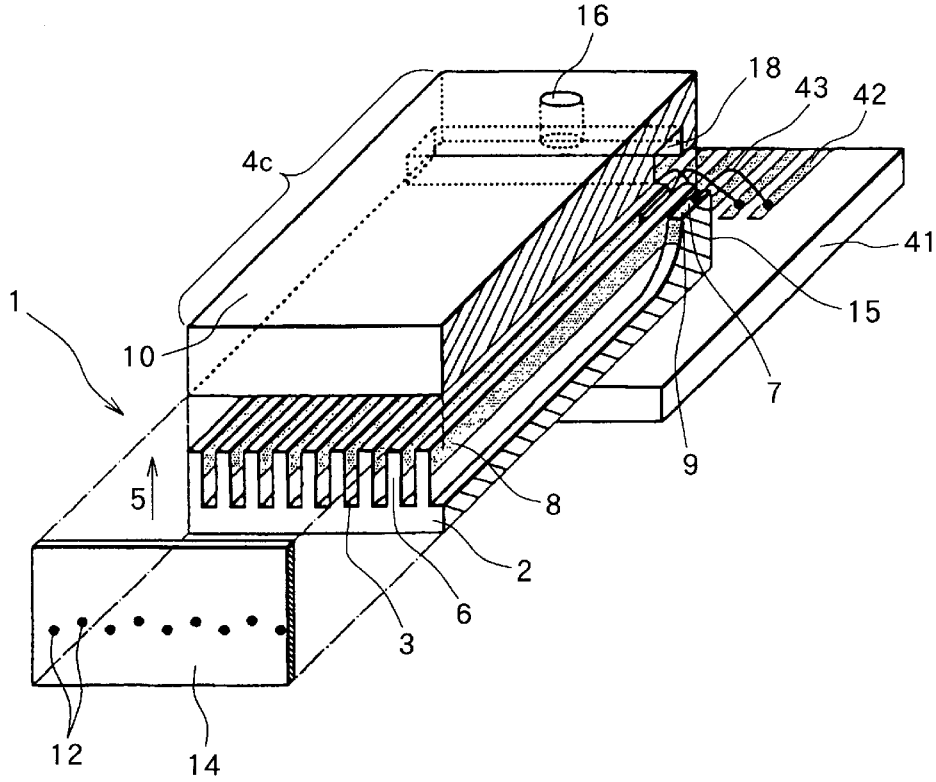
FIG. 3 is a perspective view showing a print head of the ink jet recording device according to the embodiment of the present invention.

As shown in FIG. 3, the ink jet printer head 1 includes a piezoelectric ceramic plate 2, a cover plate 10, a nozzle plate 14, and a substrate 41. A plurality of (n-number) grooves 3 are cut into the piezoelectric ceramic plate 2. Partition walls 6, which form the sides of each groove 3, are polarized in the direction indicated by arrow 5. The grooves 3 are formed at equi-distant pitch of 169 $\mu$m in parallel with each other.

The depth of each groove 3 gradually decreases with increasing proximity to the back end 15 of the piezoelectric ceramic plate 2. Shallow grooves 7 are formed adjacent to the end 15. Metal electrodes 8 are formed to the upper half of both side surfaces of each partition wall 6 by sputtering or other technique. Metal electrodes 9 are formed to the floor and side surfaces of the shallow grooves 7 by sputtering or other technique. The metal electrodes 8 formed to either side of a groove 3 are brought into electrical connection by the metal electrodes 9 formed to the floor and the side surfaces of the shallow grooves 7.

Figure 4:
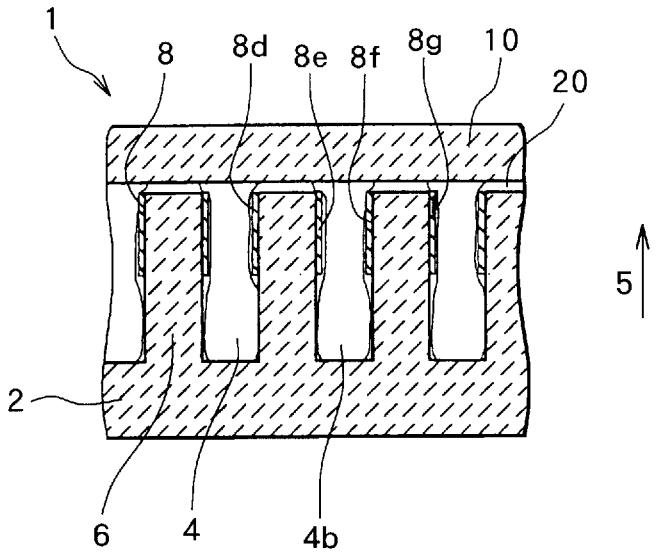
FIG. 4 is a cross-sectional view showing a part of the head of the ink jet recording device according to the embodiment of the present invention.

The cover plate 10 is made from a material such as a ceramic or resin material. An ink introduction port 16 and a manifold 18 are cut in the cover plate 10. The surface of the piezoelectric ceramic plate 2 with the grooves 3 formed therein is adhered by an epoxy adhesive 20 (see FIG. 4) to the side of the cover plate 10 with the manifold 18 formed therein. By covering the upper open end of the grooves 3 in this way, a plurality of ink chambers 4 are formed, as shown in FIG. 4, that are aligned at an equi-distant pitch in the widthwise direction of the recording medium 71.

As shown in FIG. 3, the nozzle plate 14 is adhered to the end of the piezoelectric ceramic plate 2 and the cover plate 10. Nozzles 12 are formed in the nozzle plate 14 at positions thereof corresponding to the positions of the ink chambers 4. The nozzle plate 14 is formed from a plastic material such as polyester, polyimide or polyether imide.

The substrate 41 is adhered by an epoxy adhesive to the surface of the piezoelectric ceramic plate 2 opposite the side with the grooves 3 formed therein. Conductive layer patterns 42 are formed in the substrate 41 at positions thereof corresponding to positions of the ink chambers 4. Conductor wires 43 are provided for connecting the conductive layer patterns 42 to the metal electrodes 9 of the shallow grooves 7. The conductive layer patterns 42 are connected to a driver 50 (see FIG. 6) to be described later.

Figure 7:
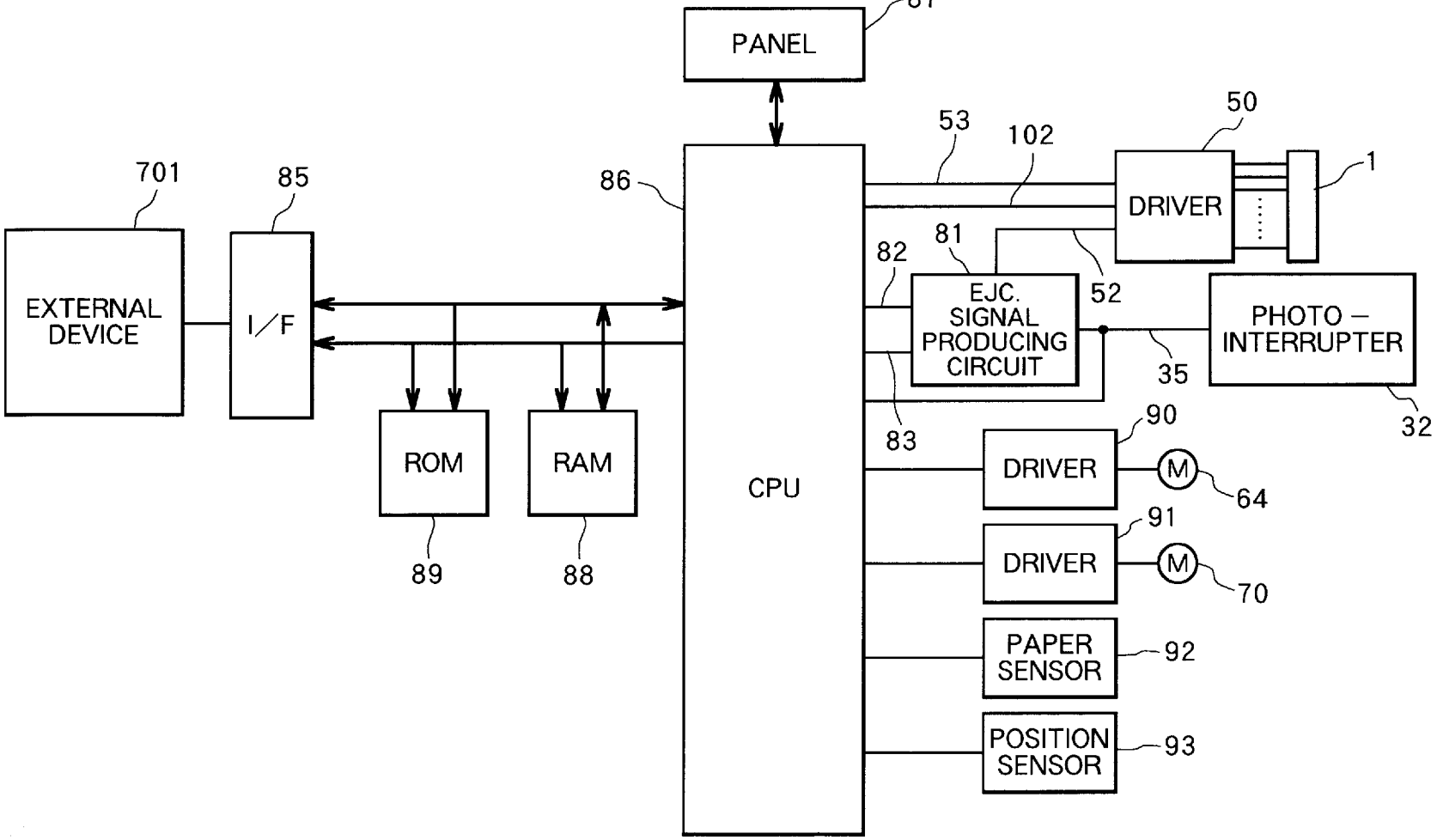
FIG. 7 is a block diagram showing a control device of the ink jet recording device according to the embodiment of the present invention.

The ink jet recording device includes a print control section, an electrical arrangement thereof being shown in block form in FIG. 7. The print control section includes a CPU 86 to which connected are a panel 87, a Centronics interface (I/F) 85, a RAM 88, a ROM 89, a motor driver 90 for driving the platen motor 64, another motor driver 91 for driving the carriage motor 70, a paper sensor 92, a position sensor 93, an ejection signal producing circuit 81, and a driver for driving the print head 1. The panel 87 is provided so that the user can enter a print mode command, a maintenance mode command or the like. The Centronics I/F 85 connects an external device 701 (e.g., a host computer) to the control section of the printer. Print data in parallel form is sent from the host computer to the control section via the Centronics I/F 85. The RAM 88 temporarily stores the print data from the host computer and various commands entered from the panel 87. The ROM 89 stores programs for driving various components of the printer. The paper sensor 92 senses displacements of the recording medium 71 in both the main scanning direction and auxiliary scanning direction. The position sensor 93 senses whether or not the head 1 has returned to a leftmost retracted position (an origin) along the platen 61.

The CPU 86 determines an operation mode of the printer and controls the various components based on the commands and data received from the panel 87, the host computer via the Centronics I/F 85, and various sensors. The CPU 86 processes the print data received from the host computer and outputs a serial dot print signal 53 to the driver 50.

The printer has a print mode and an auxiliary ejection mode. When the printer is set to the print mode, the head 1 performs printing on the recording medium 71. When the printer is set to the auxiliary ejection mode, the carriage 66 is moved to a position in confrontation with the flush station 36 and there the head 1 performs auxiliary ejection toward the pad 37 of the flush station 36.

The ejection signal producing circuit 81 receives a select signal 82 and a first print clock signal 83 (i.e., the auxiliary ejection mode clock signal) from the CPU 86 and also an encoder signal 35 from the photo-interrupter 32. When the print mode is set, the select signal 82 output from the CPU 86 is at a low level whereas when the auxiliary ejection mode is set, the select signal 82 output from the CPU 86 is at a high level. During the auxiliary ejection mode, the CPU 86 produces, using internally provided timer circuit, the first print clock signal 83 whose frequency is 5 KHz and whose high level duration of time is L/a where L is the length of the ink chamber 4 and a is the speed of sound propagating in the ink. The encoder signal 35 produced from the photo-interrupter 32 is applied not only to the ejection signal producing circuit 81 but also to the CPU 86 for providing information regarding head move distance. The CPU 86 is interrupted by the encoder signal 35 and performs measuring the head move distance based on the encoder signal 35.

Figure 8:
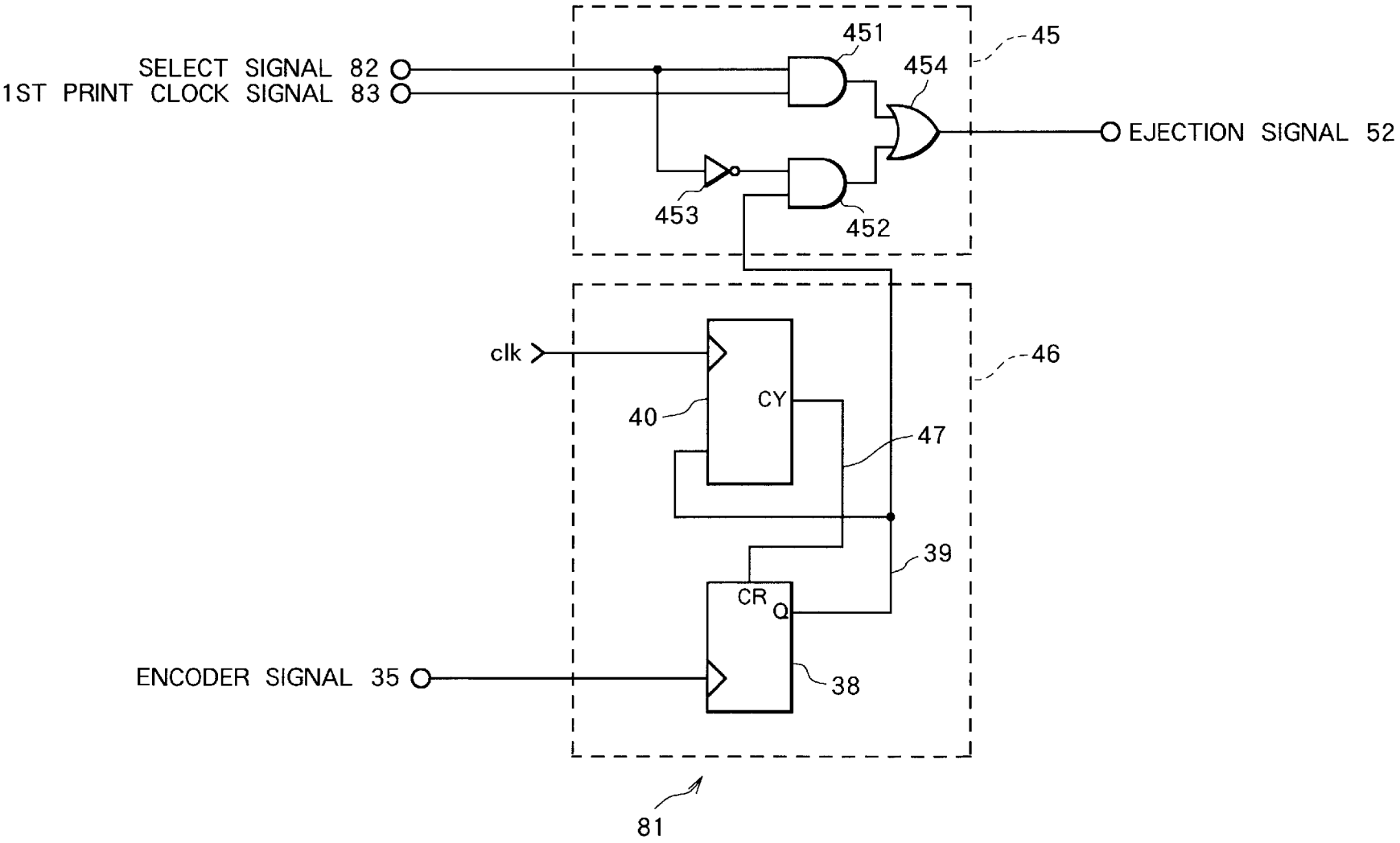
FIG. 8 is a block diagram showing an ejection signal generating circuit of the ink jet recording device according to the embodiment of the present invention.
Figure 9:
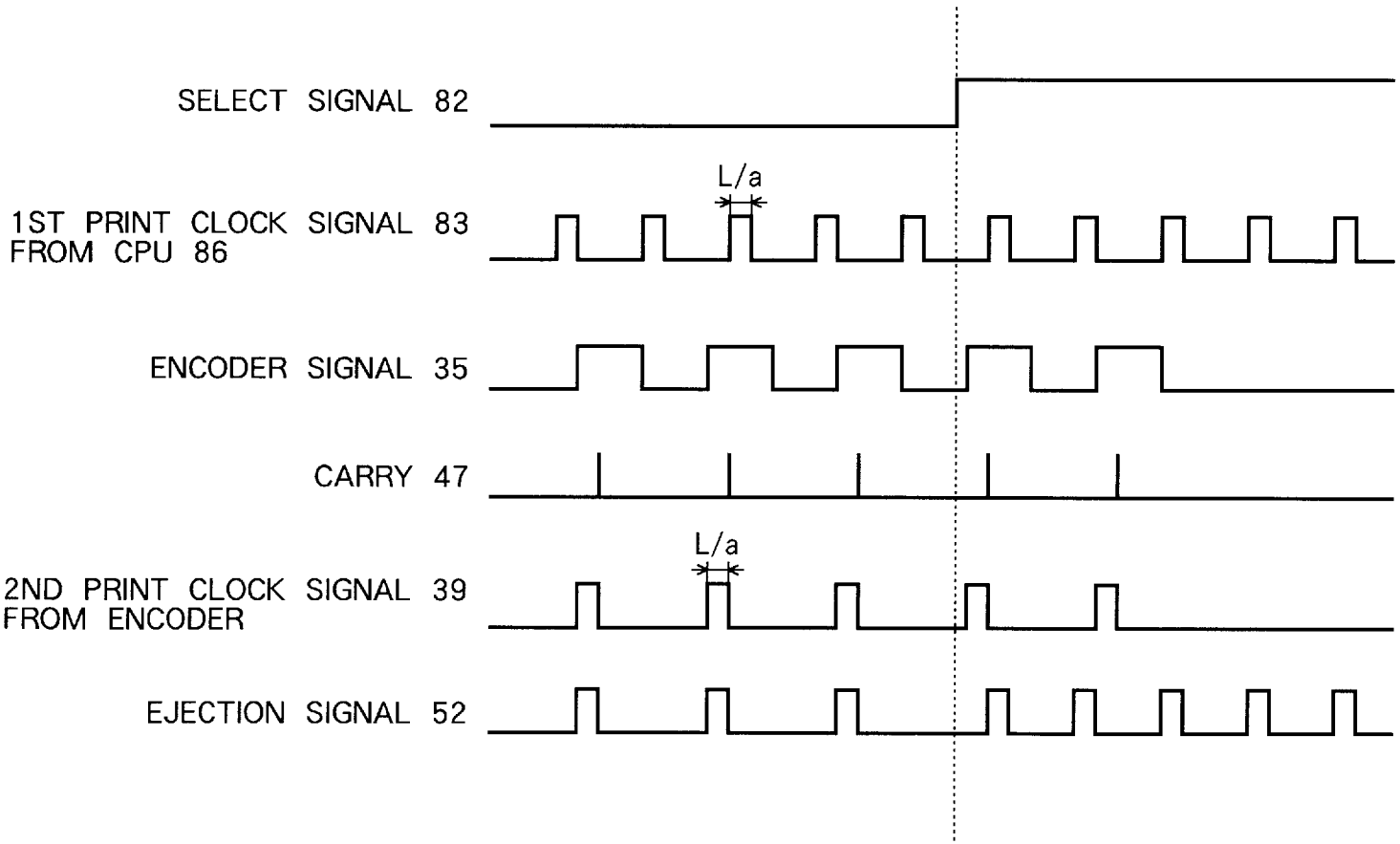
FIG. 9 is a timing chart illustrating timing relation of the ejection signal relative to related signals.

FIG. 8 shows the ejection signal producing circuit 81 and FIG. 9 is a timing chart of various signals in association with the circuit 81. As shown in FIG. 8, the ejection signal producing circuit 81 is made up of a clock selection section 45 and an encoder processing section 46.

The encoder processing section 46 includes a flip-flop 38 and a timer 40. The flip flop 38 receives the encoder signal 35 and outputs a second print clock signal 39 (i.e., the print mode clock signal) from the output terminal Q. The flip flop 38 sets the second print clock signal 39 in response to the rising edge of the encoder signal 35 from the photo-interrupter 32. The timer 40 starts measuring time when the second print clock signal 39 is raised to high level. When a predetermined period of time expires from the start of measurement, the timer 40 output a carry 40. The carry 40 is applied to CR terminal of the flip flop 38 to reset the latter. As a result, the second print clock signal 39 falls to low level. The second clock signal 39 thus defined by the encoder signal 35 and the output from the timer 40 is applied to the clock selection section 45.

The clock selection circuit 45 includes a first AND gate 451 having a first input terminal applied with the select signal 82 and a second input terminal applied with the first print clock signal 83, a second AND gate 452 having a first input terminal connected to the first input terminal of the first AND gate 451 through an invertor 453 and a second input terminal connected to the 0 output of the flip flop 38, and an OR gate 454 having two input terminals individually connected to the outputs of the first and second AND gates 451 and 452. When the select signal 82 is at low level, the first AND gate 451 is disabled whereas the second AND gate 452 is enabled so that the second print clock signal 39 from the encoder processing section 46 is output as the ejection signal 52. When the select signal 82 is at high, the second AND gate 452 is disabled so that the first print clock signal 83 is output as the ejection signal 52. The ejection final producing circuit 81 according to the embodiment of the invention is formed with a gate array or an ASIC (application specific integrated circuit) including standard cells.

Figure 6:
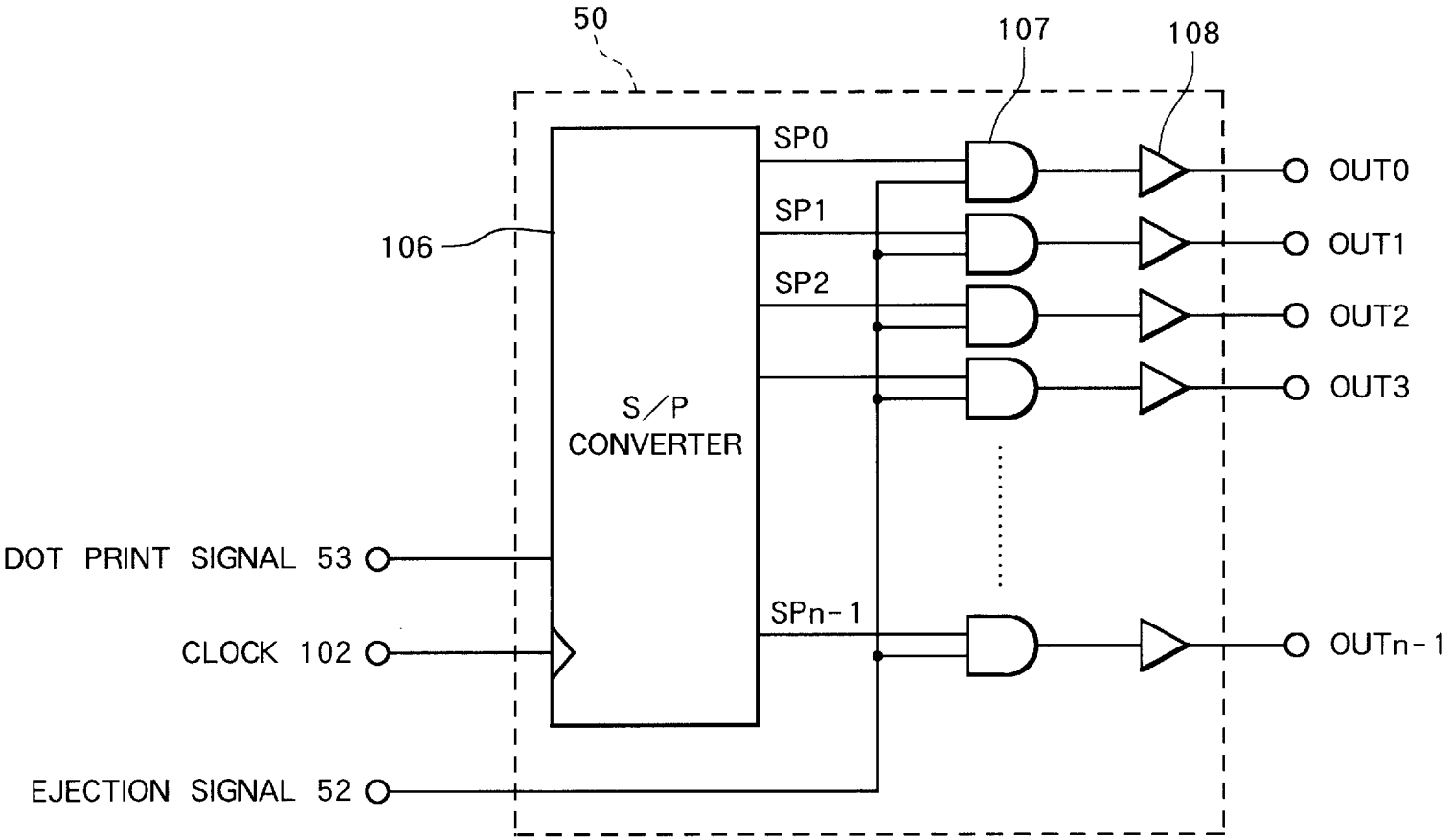
FIG. 6 is a block diagram showing a driver of the ink jet recording device according to the embodiment of the present invention.

FIG. 6 shows a driver 50 for driving the print head 1. The driver 50 includes a serial-to-parallel (S/P) converter 106, n-number AND gates 107, and n-number buffer amplifiers 108. The S/P converter 106 receives the dot print signal 53 from the CPU 86 in synchronism with clocks 102 produced from the CPU 86. The ejection signal 52 produced from the ejection signal producing circuit 81 is applied to one input terminal of each of the AND gates 107. The respective ones of outputs SP0 to SPn−1 of the S/P converter 106 are applied individually to another input terminals of the AND gates 107. The outputs of the AND gates 107 through the buffer amplifiers 108 are the outputs of the driver 50. As described, the respective ones of the output terminals OUT0 to OUTn−1 of the driver 50 are connected individually to the conductive layer patterns 42 formed on the substrate 41.

In synchronism with the clock 102, the S/P converter 106 retrieves the dot print signal 53 and shifts the retrieved signal 53 to the output terminals SP0 to SPn−1 in succession to thus provide a parallel signal. The AND gates 107 pass the outputs of the S/P converter 106 to the associated buffer amplifiers 108 only when the ejection signal 52 is at high. When the dot print signal 53 is at low level, the buffer amplifier 108 outputs 0 (zero) volt to the corresponding output terminal. On the other hand, when the dot print signal 53 is at high level, the buffer amplifier 108 outputs E volts to the corresponding output terminal. The ink jet head 1 ejects ink droplets from the corresponding nozzles 12 at a timing determined by the ejection signal 52 and in accordance with the dot print signal 53. Specifically, the voltage E is applied to the metal electrodes 8 of the ink chamber to be driven and zero voltage is applied to the remaining metal electrodes.

Figure 5:
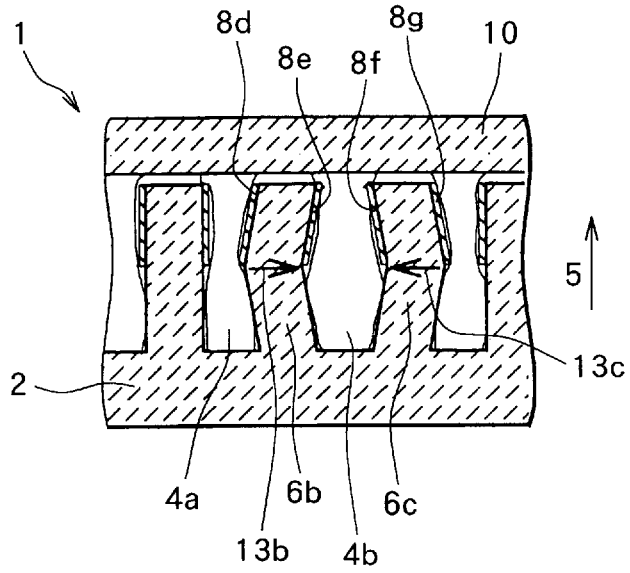
FIG. 5 is a cross-sectional view showing a part of the head of the ink jet recording device for illustrating the operation of the print head.

Next, an operation of the ink ejection device will be described while referring to FIGS. 4 and 5.

Partition walls 6 appear as shown in FIG. 4 before application of voltage. When ink is to be ejected from ink chamber 4*b*, a positive drive voltage E volts is applied to the metal electrodes 8*d* and 8*g*, and zero volt is applied to the metal electrodes 8*e* and 8*f*. That is, the metal electrodes 8*e* and 8*f* are grounded. Driving electric fields are generated in the direction indicated by arrow 13*b* in the partition wall 6*b* and in the direction indicated by arrow 13*c* in the partition wall 6*c*. Because the driving electric fields 13*b* and 13*c* are in directions that are perpendicular to the polarization direction 5, the partition walls 6*b* and 6*c* rapidly deform to part from each other by the piezoelectric shear effect. This deformation increases the volume of the ink chamber 4*b*, thereby decreasing the pressure in the ink chamber 4*b*. This condition is maintained for a duration of time L/a, during which time ink is supplied from an ink tank (not shown) to the ink chamber 4*b* by passing through the ink introduction port 16 and the manifold 18. Duration of time L/a is the duration of time necessary for a pressure wave to propagate across the lengthwise direction of the ink chamber 4*c* (i.e., from the manifold 18 to the nozzle plate 14). Duration of time L/a is determined by the length L of the ink chamber 4 and the speed of sound a through the ink.

Theories on pressure wave propagation teach that at the moment duration of time L/a elapses after the rising edge of voltage, the pressure in the ink chamber 4*b* inverts, thereby becoming a positive pressure. A zero voltage is applied to the metal electrodes 8*d* and 8*g* so that the partition walls 6*b* and 6*c* revert to their initial shape (refer to FIG. 4). The pressure generated when the partition walls 6*b* and 6*c* return to their initial shape is added to the inverted positive pressure so that a relatively high pressure is generated in the ink chamber 4*b*, so that ink is ejected from the nozzle 12.

Next, description will be made with respect to operation of the ink jet head 1 when the auxiliary ejection mode is set. The auxiliary ejection mode is provided for smoothly performing ink ejection and auxiliary ejection is taken place each time when printing is to be performed and when printing on an A4 size paper is finished. Printing on the recording medium 71 is performed after the auxiliary ink ejection.

When the CPU 86 receives a print command from the host computer or when printing on the A4 size paper is finished, the carriage 66 is moved to the flush station 36 by the carriage motor 70. The auxiliary ink ejection is performed in this position. Next, the select signal 82 is raised to high so that the first print clock signal from the CPU 86 is output from the ejection signal producing circuit 81. The CPU 86 outputs dot print signal 53 to the driver 50 in synchronism with the clocks 102 for the duration of time L/a.

The driver 50 applies E volts to all the metal electrodes 8 for a duration of time (L/a) when the first print clock signal 83 is at high level. The head 1 ejects ink droplets from the nozzles 12 toward the pad 37 of the flush station 36. By this ink ejection, the residual ink remained in the edge portion of the nozzles can be flushed out and therefore the subsequent printing will not suffer from clogging of ink.

After the auxiliary ink ejection is finished, the recording device is placed in the printing mode. The CPU 86 outputs a low level select signal 82 to the ejection signal producing circuit 81 so that the latter circuit outputs the second print clock signal 39 as the ejection signal 52. Then, the carriage motor 70 is energized to move the carriage 66 along the platen 61. The photo-interrupter 32 provided in the lower surface of the carriage 66 outputs one pulse worth of the encoder signal 35 each time when the head 1 moves 169 $\mu$m. The encoder signal 35 is applied to the ejection signal producing circuit 81 and is output therefrom as the ejection signal 52. The encoder signal 35 is also applied to the CPU 86 for determining a transfer timing of the dot print signal 53.

The driver 50 applies the voltage E to the metal electrodes 8 designated by the dot print signal 53 for a duration of time (L/a) when the second print clock signal 39 is at high level. The head 1 ejects ink droplets from the corresponding nozzles 12 toward the recording medium 71. The ejection signal 52 is produced in complete synchronism with the movement of the carriage 66. Further, the high level duration of the ejection signal 52 is accurately determined by the encoder processing section 46. Therefore, a high quality printing can be accomplished without the ejection signal produced by the CPU 86.

As described, the print clock signal for the auxiliary ejection mode is produced by the CPU, and the print clock signal for the printing mode is produced by specific hardware on the basis of the encoder signal produced in proportion to the moving distance of the carriage. As such, with CPUs which are inexpensive and low in processing capability, a high speed and high quality printing can be achieved and the auxiliary ink ejection can be carried out without providing a special circuit for determining a timing of the auxiliary ejection.

While only one exemplary embodiment of this invention has been described in detail, those skilled in the art will recognize that there are many possible modifications and variations which may be made in this exemplary embodiment while yet retaining many of the novel features and advantages of the invention. For example, although the exemplary embodiment uses the ink head using the piezoelectric ceramic plate, the head may be of the type in which change of the phase of ink caused by thermal energy ejects the ink droplets such as a bubble jet type recording device.

Further, although the photo-interrupter has been described as a means for producing information regarding the head position, the head position may be given by the number of pulses applied to the carriage motor if a stepping motor is used therefor.

What is claimed is:

1. An ink jet recording device comprising:

a recording head movable with respect to a recording medium and ejecting ink droplets to record data when electrical energy is supplied;

head information generating means for generating information regarding a moving amount of said recording head, said head information generating means being in operative relationship with said recording head;

first ejection signal generating means for generating a first ejection signal based on the information generated by said head information generating means, said first ejection signal generating means being connected to said head information generating means;

a driver for driving said recording head, said driver being connected to said recording head;

control means for receiving print data from an external device and producing a dot print signal based on the print data, said control means setting said driver to either one of a print mode and an auxiliary ejection mode and being connected to said external device and to said driver, said control means including second ejection signal generating means for generating a second ejection signal, wherein in the print mode, the dot print signal is applied to said driver, and in the auxiliary ejection mode, a predetermined dot print signal is applied to said driver; and selection means for receiving the first ejection signal from said first ejection signal generating means and receiving the second ejection signal from said second ejection signal generating means, selecting one of the first ejection signal and the second ejection signal, and applying the selected ejection signal to said driver, said selection means being connected to said said first ejection signal generating means, said second ejection signal generating means and said driver, wherein the first ejection signal is selected when the print mode is set and the second ejection signal is selected when the auxiliary ejection mode is set, and wherein in the print mode, said driver drives said recording head to supply electrical energy in accordance with the first ejection signal and the dot print signal, and in the auxiliary ejection mode, said driver drives said recording head to supply electrical energy in accordance with the second ejection signal and the predetermined dot print signal.

2. An ink jet recording device according to claim 1, wherein said first ejection signal generating means and said selection means are formed with an application specific integrated circuit, and said control means includes a central processing unit.

3. An ink jet recording device according to claim 1, wherein said head information generating means comprises an encoder for generating pulses in accordance with movement of said head, a number of pulses generated by said encoder being in proportion to the moving amount of said recording head.

4. An ink jet recording device according to claim 1, wherein said control means sets the recording device to the auxiliary ejection mode when said ink jet recording device is powered.

5. An ink jet recording device according to claim 1, wherein said control means sets said driver to the auxiliary ejection mode when an amount of data recorded by said recording head exceeds a predetermined value in the printing mode.

6. An ink jet recording device comprising:

a power switch;

a recording head connected to said power switch for ejecting an ink droplet when electrical energy is supplied;

a flushing member disposed in a predetermined position and dimensioned to receive the ink droplets ejected from said recording head when said recording head is aligned with said flushing member;

a driver connected to said recording head for selectively driving said recording head in one of a print mode and an auxiliary ejection mode, wherein when said driver is set to the print mode, the ink droplet is ejected from said recording head to record data on a recording medium and when said driver is set to the auxiliary ejection mode, the ink droplet is ejected from said recording head toward said flushing member, mode setting means for setting said driver to operate selectively in one of the auxiliary ejection mode and the print mode, said mode setting means being connected to said driver;

moving means for moving said recording head, said moving means being connected to said recording head;

head information generating means for generating information regarding a moving amount of said recording head, said head information generating means being in operative relationship with said recording head;

a central processing unit that generates an auxiliary ejection mode clock signal;

first ejection signal generating means for generating a first ejection signal based on the information generated by said head information generating means, said ejection signal generating means being connected to said head information generating means;

second ejection signal generating means for generating a second ejection signal based on the auxiliary election mode clock signal generated by said central processing unit, said second ejection signal generating means being connected to said central processing unit; and selection means for receiving the first ejection signal from said first ejection signal generating means and receiving the second ejection signal from said second ejection signal generating means, selecting one of the first ejection signal and the second ejection signal, and applying a selected ejection signal to said driver, said selection means being connected to said first ejection signal generating means, said second ejection signal generating means and said driver, wherein the first ejection signal is selected when the print mode is set and the second ejection signal is selected when the auxiliary ejection mode is set, wherein in the print mode, said driver drives said recording head to supply electrical energy at a timing determined by the first ejection signal, and in the auxiliary ejection mode, at a timing determined by the second ejection signal.

7. An ink jet recording device according to claim 6, wherein said central processing unit instructs said moving means to move said recording head to face said flushing member when said mode setting means sets the auxiliary ejection mode.

8. An ink jet recording device according to claim 7, wherein said central processing unit instructs said mode setting means to set to the auxiliary ejection mode when said power switch is operated.

9. An ink jet recording device according to claim 7, wherein said central processing unit instructs said mode setting means to change the print mode to the auxiliary ejection mode when an amount of data recorded by said recording head exceeds a predetermined amount in the printing mode.

10. An ink jet recording device according to claim 7, wherein said head information generating means comprises an encoder for generating pulses in accordance with movement of said head, a number of pulses generated from said encoder being in proportion to the moving amount of said recording head.

11. An ink jet recording device according to claim 10, wherein the first ejection signal further determines a duration of time at which the electrical energy is supplied to said recording head.

12. An ink jet recording device according to claim 11, wherein said recording head has partition walls defining an ink channel, said ink channel having a length, and wherein the duration of time determined by said first ejection signal is determined by the length of said ink channel and sound propagating speed in ink filled within the ink channel.

13. An ink jet recording device according to claim 1, wherein said first ejection signal generating means generates the first ejection signal based on a print mode clock signal, the print mode clock signal being distinct from an auxiliary mode clock signal on which the second ejection signal is based.

14. An ink jet recording device according to claim 1, wherein said control means outputs a selection signal to said selection means and said selection means selects one of the first ejection signal and the second ejection signal in response to the selection signal.

15. An ink jet recording device according to claim 6, wherein said first ejection signal generating means generates the first ejection signal based on a print mode clock signal, the print mode clock signal being distinct from an auxiliary mode clock signal on which the second ejection signal is based.

16. An ink jet recording device according to claim 6, wherein said central processing unit outputs a selection signal to said selection means and said selection means selects one of the first ejection signal and the second ejection signal in response to the selection signal.

* * * * *